US005533369A

United States Patent [19]

Valdajos-Gallego

[11] Patent Number: 5,533,369

[45] Date of Patent: Jul. 9, 1996

[54] SAFETY LOCK AND FLAT KEY FOR SUCH A LOCK

[75] Inventor: Luis Valdajos-Gallego, Fuenterrabia, Spain

[73] Assignee: Talleres de Escoriaza, S.A. (TESA), Irun, Spain

[21] Appl. No.: 237,673

[22] Filed: May 4, 1994

[30] Foreign Application Priority Data

May 5, 1993 [FR] France ..... 93 05354

[51] Int. Cl.[6] ..... E05B 27/00

[52] U.S. Cl. ..... 70/493; 70/358; 70/395; 70/398; 70/409

[58] Field of Search ..... 70/358, 378, 395, 70/397–399, 401, 405–407, 409, 490, 492, 493

[56] References Cited

U.S. PATENT DOCUMENTS

| | | | |
|---|---|---|---|
| 3,412,588 | 11/1968 | Schwegler | 70/409 X |
| 3,877,267 | 4/1975 | Harris, Jr. | 70/378 X |
| 4,343,166 | 8/1982 | Hofmann | 70/409 X |
| 4,377,082 | 3/1983 | Wolter | 70/409 X |
| 4,612,787 | 9/1986 | Prunbauer et al. | 70/409 X |
| 4,660,396 | 4/1987 | Garro | 70/358 |
| 4,667,495 | 5/1987 | Girard et al. | 70/409 X |
| 5,131,249 | 7/1992 | Baden et al. | 70/409 X |
| 5,170,651 | 12/1992 | Errani | 70/399 X |

FOREIGN PATENT DOCUMENTS

| | | | |
|---|---|---|---|
| 213069 | 3/1987 | European Pat. Off. | 70/358 |
| 431550 | 6/1991 | European Pat. Off. | 70/409 |
| 472495 | 2/1992 | European Pat. Off. | 70/358 |
| 2396144 | 3/1979 | France | 70/358 |
| 2492872 | 4/1982 | France | 70/409 |
| 2637831 | 3/1977 | Germany | 70/406 |
| 3314511 | 10/1984 | Germany | 70/406 |
| 3542008 | 6/1987 | Germany | 70/493 |
| 3817494 | 11/1989 | Germany | 70/493 |
| 4035934 | 6/1991 | Germany | 70/358 |
| 6606735 | 11/1966 | Netherlands | 70/358 |
| 2161204 | 1/1986 | United Kingdom | 70/358 |

*Primary Examiner*—Steven N. Meyers
*Assistant Examiner*—Suzanne L. Dino
*Attorney, Agent, or Firm*—Christopher A. Pastel; Alfred W. Froebrich; Thomas R. Morrison

[57] ABSTRACT

A safety lock and key includes a cylindrical stator and rotor having conventional spring-loaded moving rotor pins and moving stator pins. A first rotor pin/stator pin combination is at substantially 45 degrees to a first face of the key while a second rotor pin/stator pin combination is substantially perpendicular to a second face of the key on the opposite side. The centerlines of the rotor pin/stator pin combinations pass through the center of rotation of the rotor. A housing in the key contains a moving element and emerges from the first face of the key inclined at the same angle as the first rotor pin/stator pin combination. The housing also emerges from the second face of the key through a tapered bore that receives the second rotor pin/stator pin combination. A tapered head of the second rotor pin engages a rear portion of the moving element in the housing, thus engaging the moving element with the first rotor pin/stator pin combination. Inserting the key into the rotor thus moves the rotor pin/stator pin combinations from a locked position to an unlocked position.

11 Claims, 3 Drawing Sheets

SAFETY LOCK AND FLAT KEY FOR SUCH A LOCK

Figure 1:
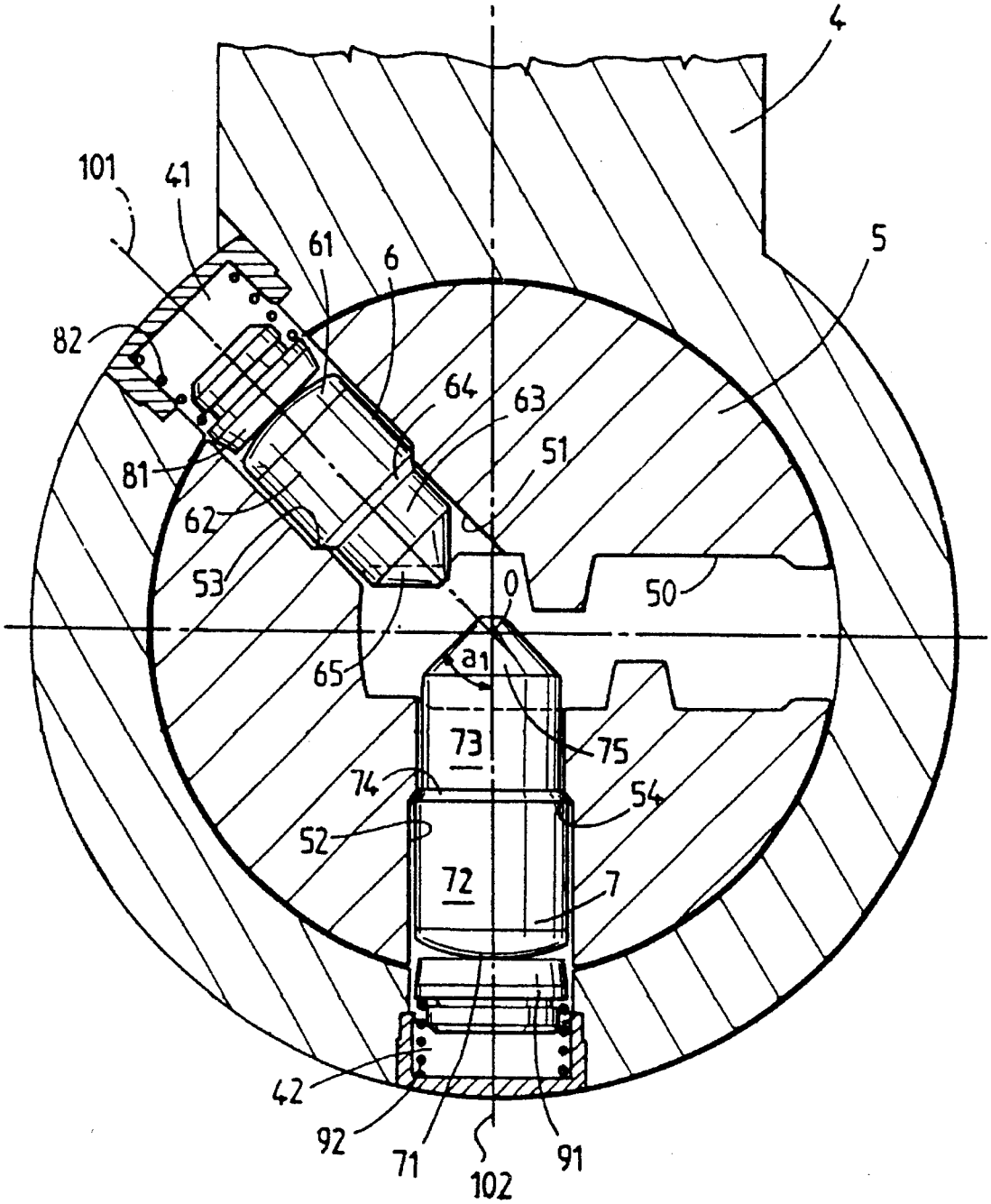

The object of this invention is a safety lock comprising a cylindrical stator and rotor, the rotor having a key channel intended to receive a flat key which has active bores engaging with the spring-loaded locking pins, arranged in the stator and in the rotor, at least one moving element comprising a cylindrical body and an essentially tapered head, held in a recess inside the key and engaging with at least one moving rotor pin aligned with a moving spring-loaded stator pin.

The invention also concerns a flat key comprising a shank with two main faces and two narrow side faces, several active bores being formed in at least one of the main faces and at least one moving element comprising a cylindrical body and an essentially tapered head being held in a housing inside the key.

Within the field of safety locks and keys adapted for such locks, maximizing the complexity of reproduction of the key is desirable as well as ensuring the greatest possible number of different combinations for the assembly consisting of a lock and key designed for this lock.

To this aim, a proposal has already been made to introduce moving elements in the housings formed in the shank of the key. These moving elements may project out of the body of the key engaging with the locking pins of the rotor of the lock.

According to a first well known embodiment, a moving element is placed inside a conduit which perpendicularly crosses the broad face of the key and is locked on one side by a small plate. A spring placed between the small plate and the moving element allows the shifting of the latter perpendicularly to the broad faces of the key. Such an embodiment prevents the forming of the necessary bores of the tapered combination craters, both in the face across which the moving element passes and in the opposite face in which the small plate is located. In addition, two bores per housing are taken, which reduces the possible combinations. In addition, the penetration stroke of the of moving element is limited by the thickness of the key and in this thickness, the spaces occupied by the small plate and the compressed spring must be reserved, so that the stroke of the moving element is very limited and does not allow numerous combinations.

In a second well known embodiment, it has been proposed that a moving element be arranged, by an external action, in a transverse orifice in the body of the key which passes right through this key through the narrow sides, and which is of circular section and having width greater than the dimension of the key in this direction, in order to be able to emerge from this key. The making of a housing situated in the edge of the key and coming out on both sides eliminates the possibility of making the tapered combination indentations in this location in the broad faces of the key which this type of key must have. In addition, In such an embodiment where the moving element moved by external action must project out of the actual cross-section of the key, the access conduit which the lock has to allow the introduction of the key cannot be made equal to the actual cross section of the key, unless the conduit is adequately enlarged so that the moving element may pass unhindered until it has reached its actuating position. This complicates the design and reduces security. The use in each lock of a fixed internal stop which must bring about the shifting of the mobile element does in practice cancel out the possibility of continuing to use a moving element in each key by virtue of the lack of space available. Finally, considering that the transverse moving element projects out of the body of the key, if this key, while outside the lock, receives a simultaneous pressure on both sides corresponding to the two ends of the moving element, this moving element may be damaged and the key may be rendered unusable.

According to yet another well known embodiment the moving elements are arranged in chamfered blind holes formed In the narrow side of the shank of the key and perpendicular to it, with each moving body having an active head, a rear part of which is arranged inside the blind hole and engaging a spring acting in a movement direction intended to push the moving elements out of the blind hole. In this embodiment, the moving elements may be completely concealed inside the blind holes. Such an embodiment makes it possible in particular to make reversible keys. Although giving a certain number of advantages compared with the previously well known methods of production, this type of key does not make it possible to increase substantially the number of possible combinations, and does make it practically impossible to reproduce the key.

The present invention is intended to remedy the aforementioned disadvantages and to allow the production of safety locks and safety keys, the duplication of which is rendered practically impossible and in any case extremely difficult for people having no knowledge of the set of different parameters necessary to make such a safety lock system.

The present invention is intended more particularly to allow a very substantial increase in the number of possible combinations for the various keys, compared with the well known type of keys.

These aims are achieved by a safety lock comprising a cylindrical stator and rotor, the rotor having a key channel intended to receive a flat key which has active bores engaging with spring-loaded locking pins, arranged in the stator and in the rotor, at least one moving element comprising a cylindrical body and an essentially tapered head being held in a housing inside the key and engaging with at least one moving rotor pin aligned with a moving spring-loaded stator pin. Each moving element is placed in a housing which comes out through a first orifice, formed through one of the principal faces of the shank of the key near a lateral extremity of this shank and having an inclination largely equal to 45 degrees in relation to a plane perpendicular to the longitudinal median plane of the shank parallel to the principal faces, so that the tapered head of each moving element engages with a tapered head of a first mobile rotor pin aligned with a first mobile stator pin, the common centerline of which passes through the centerline of rotation of the rotor, so that the housing also comes out through a second orifice in a tapered bore made in the other principal face of the shank of the key and so that the rear part of the body of the moving element engages with a tapered head of a second moving rotor pin aligned with a second moving spring-loaded stator pin, the common centerline of which is perpendicular to the longitudinal median plane of the shank and passes through the centerline of rotation of the rotor.

A lock in accordance with this invention may also have the following more particular characteristics:

The centerline of the housing is slightly staggered relative to the centerline of the first moving rotor and stator pins.

The tapered bore of the tapered head of the second moving pin has an angle at the top substantially equal to 45 degrees.

The angle at the top formed by the tapered head of the moving element is substantially equal to 45 degrees.

Each of the first and second moving rotor pins has first and second cylindrical parts of different diameters, the connecting part of which may butt against a shoulder formed by the bores of the rotor in which the first and second cylindrical parts of different diameters are accommodated. The first and second orifices of the housing each have a retaining zone which prevents the moving element from escaping completely from these orifices.

The lock has several moving elements arranged in different planes perpendicular to the longitudinal median plane of the shank of the key, a moving element in each of the different planes engaging with, on the one hand, a first moving rotor pin, and on the other hand, a second moving rotor pin arranged in the plane of the moving element concerned, perpendicularly to the centerline of rotation of the rotor.

The invention also concerns a flat key comprising a shank with two principal faces and two narrow lateral faces, several active bores being formed in at least one of the principal faces and at least one moving element comprising a cylindrical body and a largely tapered head being held in a housing inside the key, characterized by the fact that each moving element is placed in a housing which comes out through a first orifice formed through one of the principal faces of the shank of the key near one lateral extremity of this shank, having an inclination substantially equal to 45 degrees in relation to a plane perpendicular to the longitudinal median plane of the shank parallel to the principal faces and also coming out through second orifice in a tapered imprint formed in the other principal face of the shank of the key.

More particularly, the first and second orifices of the housing each have a retention zone preventing the moving elements from escaping completely through these orifices.

The flat key in accordance with the invention may be reversible and exhibit a symmetrical configuration in relation to a longitudinal median plane perpendicular to the principal faces of the key.

Figure 2:
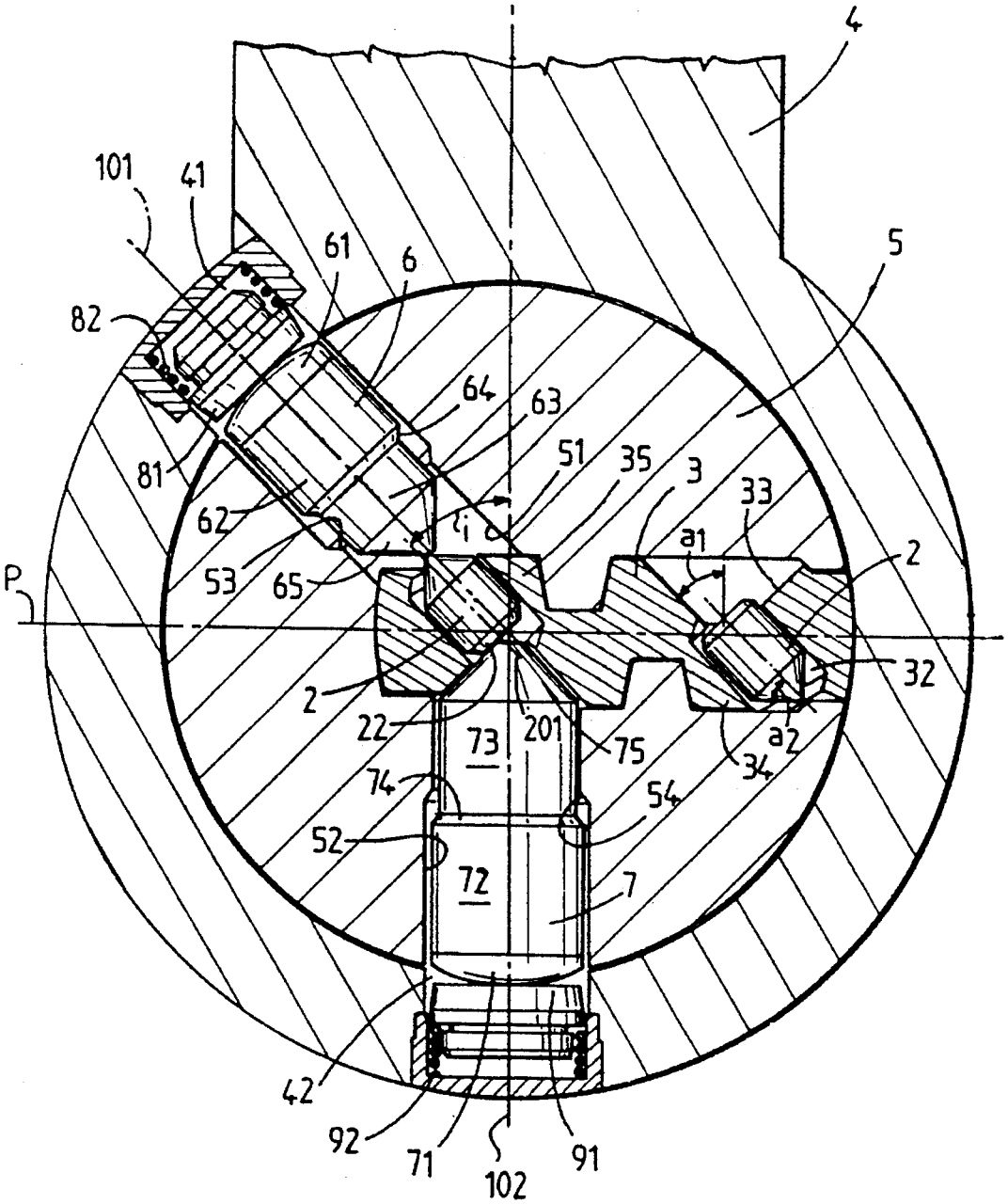
Figure 3:
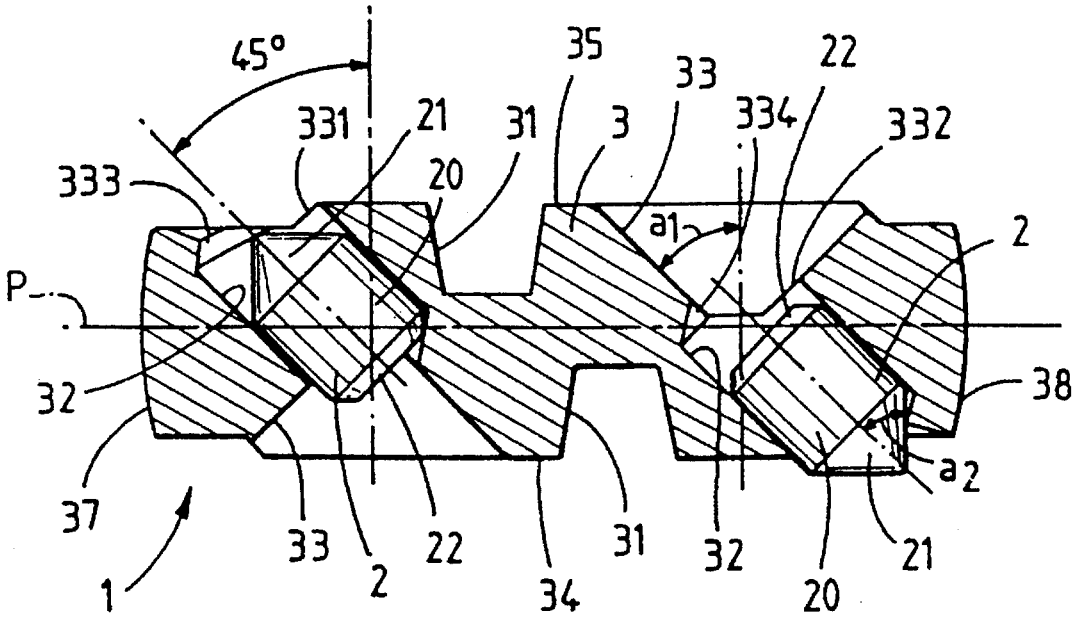
Figure 4:
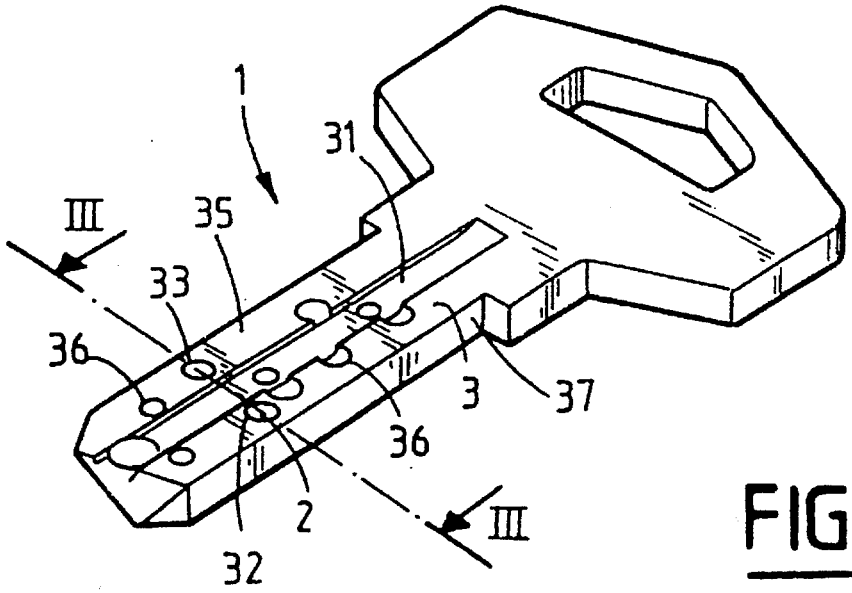

Other characteristics and advantages of the intention shall become clear from the following description of a particular embodiment, given as a non-exhaustive example in reference to the attached drawings, where:

FIG. 1 is a sectional view of a safety lock in accordance with the invention, in a plane perpendicular to the centerline O of the rotor, no key being engaged in the key housing provided in the rotor of the lock, FIG. 2 is a sectional view similar to that of FIG. 1, but with a designed key introduced into the key housing of the rotor of the lock, FIG. 3 is a transverse sectional view of the shank of a key in accordance with the invention, along plane III—III of FIG. 4. showing the moving elements included in this key, and FIG. 4 is a perspective view of an example of a key in accordance with the invention.

The invention concerns safety locks comprising a cylindrical internal rotor 5 which may rotate around a centerline O, inside a stator 4 comprising a cylindrical part surrounding rotor 5 (FIG. 1). Central rotor 6 itself comprises a recessed portion extending longitudinally to constitute a housing 50 designed for a flat key 1 such as the key shown in FIGS. 3 and 4.

Flat key 1 according to the invention essentially has a shank 3 intended to penetrate into key housing 50 of the lock in FIG. 1. This shank 3 has two principal faces 34, 35 and two narrow sides or edges 37, 38 (FIGS. 3 and 4). Longitudinal ribs 31 may be formed, in a staggered manner, in each of the principal faces 34, 35. Tapered hollow bores 36 formed in the principal faces 34, 35 of shank 3 of key 1 engage, in a well known manner, with spring-loaded locking pins, arranged in the lock perpendicularly to the broad faces of housing 50 of key 1. Each locking pin comprises a first part intended to penetrate into one of bores 36 and a second part placed in stator 5 of the lock. Bores 36 naturally have varied diameters and depths, so as to increase the number of possible combinations, and engage with rotor pin parts of different lengths. When key 1 is engaged in housing 50 of the corresponding lock, the various rotor pins are arranged in the rotor without penetrating into stator 4 and the various stator pins are placed in stator 4 without penetrating into rotor 5, allowing a free rotation movement of rotor 5 provided that the other elements peculiar to the key in accordance with the invention are also designed for the lock. Otherwise, in the absence of the key, the stator pins, due to the action of the associated springs, penetrate partially into rotor 5, ensuring locking of this rotor and preventing it from turning in relation to the stator, until the introduction of a key ensures the withdrawal of the rotor pins which themselves push back the stator pins against the action of the springs.

A reversible key is shown in FIGS. 3 and 4 which has a symmetrical configuration in relation to a longitudinal median plane perpendicular to the principal faces 34, 35. The invention does, however, also apply to keys 1 which do not have this reversibility.

In accordance with the invention at least one moving element 2 comprising a cylindrical body 20 and an essentially tapered head 21, the angle at the top of which a2 may for example be substantially equal to 45 degrees is held in a housing 32 inside shank 3 of key 1. FIG. 3 shows the use of two moving elements 2 of a reversible key, in one and the same transverse sections of shank 3 of key 1.

Each moving element 2 is placed in a housing 32 which comes out through a first orifice 331 formed through one of the principal faces 34, 35 of shank 3 near one lateral extremity of this shank. Each housing 32 also comes out through a second orifice 332 in a tapered bore 33 formed in the other principal face 35, 34 of the shank. The first and second orifices 331, 332 of each housing 32 each have a retention zone 333, 334 which prevents moving element 2 from escaping completely through these orifices 331, 332.

Each housing 32 has an inclination i substantially equal to 45 degrees relative to a plane perpendicular to the longitudinal median plane P of shank 3 parallel to the principal faces 34, 35.

When the key is outside its housing, as in the case of FIGS. 3 and 4, each moving element 2 may be completely concealed inside its housing 32, as in the case of top moving element 2 located to the left of FIG. 3, or come partially out of its housing, as shown in FIG. 3 for the bottom moving element 2 located on the right hand side of FIG. 3.

FIG. 1 shows a lock in accordance with the invention intended to engage with a key such as that in FIG. 3.

In such a lock, a first moving rotor pin 6 is aligned with a first moving stator pin 81, the two pins 6, 81 exhibiting a common centerline 101 which passes through the centerline of rotation O of rotor 5 and exhibits in relation to the principal faces of housing 50 an inclination substantially equal to 45 degrees.

The pair of pins 6, 81 is intended to engage with moving element 2 of key 1. In the absence of a key in housing 50 (FIG. 1), stator pin 81 is partially out of its housing 41 and partially penetrates into bore 61 of rotor pin 6, thereby contributing to preventing the rotation of rotor 5. The bore 51 has a shoulder 53 making it possible to retain rotor pin 6, a tapered head 65 of which only penetrates partially into the housing of key 50. Rotor pin 6 has essentially two cylindrical parts 62, 63 of different diameters, a connecting part 64 of which may butt against shoulder 53. The pin of rotor 6 has a convex shoulder 61 on which the pin of stator 81 comes to rest. A spring 82 is inserted between housing 41 and the pin of stator 81.

A second moving rotor pin 7 of rotor 5 is aligned with a second moving stator pin 91 of stator 4 similarly to the pair of pins 6, 81. However, a common centerline 102 of the pair of pins 7, 91, which also passes through the centerline of rotation O of rotor 5, is perpendicular to the principal faces of housing 50. A tapered head 75 of the pin 7 of rotor 5 penetrates into the housing 50 in the absence of a key, pushed by the pin of stator 91, itself pushed out of its housing 42 by a spring 92 and contributing to preventing the rotation of rotor 5. The pin 7 of rotor 5 may have convex shoulder 71, cylindrical part 72, cylindrical part 73, connecting part 74, and tapered head 75 in a way completely similar to corresponding portions 61 to 65 of the pin 6 of rotor 5, the connecting part 74 of pin 7 then coming to rest, in the absence of a key, against a retaining shoulder 54 of a bore 62 which takes the pin 7 of rotor 5. The tapered head 75 of pin 7, intended to engage with a tapered bore 33 of the key, has an angle at the top (a1) equal to 45 degrees.

In accordance with the invention, the tapered head 75 of pin 7 is also intended to act on a shoulder 22 of moving element 2 of key 1, as will be explained hereinafter with reference to FIG. 2 which shows the shank 3 of key 1 engaged in housing 50.

It can be seen in FIG. 2 that moving element 2 located to the left of the drawing is partially out of its housing 32 to push back the pair of pins 6, 81 against the action of spring 82. The position of this moving element 2, which is not fully out of its housing, is determined by head 75 of rotor pin 7 which has engaged in the tapered bore 33 of key 1, which is connected to the rear part of housing 32. Head 75 of pin 7 therefore comes to rest against shoulder 22 of moving element 2 to bring about a defined position of this moving element 2 such that the pin 81 of stator 4 is pushed back completely into its housing 41, without shoulder 61 of pin 6 coming out of rotor 5, thereby allowing a rotation of rotor 5 in relation to stator 4.

In accordance with the invention, the pair of pins 7, 91 therefore not only plays the classic role of pairs of pins acting on bores 36 of principal faces 34, 35 of the shank 3 of key 1, by allowing various combinations depending on the dimensions of bore 33 and tapered head 75, to ensure a correct positioning of pins 7 and 91 when key 1 is introduced into its housing, but head 75 of pin 7 contributes in bringing about a special positioning of moving element 2 when engaged with the pair of additional pins 6, 81. The fact that the active position of moving element 2 engaging with pin 6 does not correspond to the maximum possible projecting position of moving element 2 in relation to its housing 32 makes the unauthorized reproduction of a key 1 designed for a given lock particularly difficult.

It should be noted that in the special mode of production of FIG. 2, a centerline 201 of housing 32 of active moving element 2 is slightly staggered relative to centerline 101 of the first moving pins of rotor 6 and stator 81.

The lock in accordance with the invention allows the use of reversible keys with a pair of moving elements 2 placed in one and the same transverse section of the shank of the key, and nonactive moving element 2 (on the right hand side in FIG. 2) can be retracted completely into its housing 32.

The lock in accordance with the invention also makes it possible to use several moving elements 2 arranged in different planes perpendicular to the longitudinal median plane of shank 3 of key 1, a moving element 2 in each of the different planes engaging with, on the one hand, first moving rotor pin 6, and on the other hand, a second moving rotor pin 7 arranged in the plane of the moving element 2 concerned, perpendicularly to the centerline O of rotation of rotor 5.

The lock in accordance with the invention offers the possibility of changing a number of parameters to modify the production of moving elements 2, corresponding housings 32 and rotor pins 6, 7 engaging with the moving elements 2.

The tapered heads 65, 75 have an angle at the top (a1) preferably equal to 45 degrees, but which may, however, differ slightly from this figure, for example by 1 or 2 degrees.

In the same way, it is an advantage to incline housings 32 and moving elements 2 by about 45 degrees relative to a plane perpendicular to the longitudinal median plane P of shank 3, but neighboring inclinations (i) which are not very different, for example between 35 and 55 degrees, may also be suitable, which increases the possibilities of production and renders copies more difficult.

In the description given with reference to FIGS. 1 and 2, a particular embodiment has been described in which the centerline of a moving element 2 and that of its housing 32 are staggered but parallel to centerline 101 of pin 6. It is possible, whilst preserving the same inclination for pin 6, and the same shape of its head 65, to choose a slightly different inclination for moving element 2 and its housing 32 whilst adapting the angle at the top (a2) of tapered head 21 of moving element 2, which offers numerous possibilities of different combinations.

It is in particular possible, within one and the same key, to have moving elements exhibiting different inclinations or lengths.

The fact that moving elements 2 are components which can be moved within the key, which cannot be withdrawn and which may exhibit different inclinations or lengths makes unauthorized reproduction of the key practically impossible.

I claim:

1. A safety lock and key comprising:

a cylindrical stator;

a rotor;

the rotor having a key channel for receiving a flat key;

at least one moving element comprising a cylindrical body and a tapered head being held in a housing within the key and engaging with a first moving rotor pin in the rotor aligned with a spring-loaded first moving stator pin in the stator;

each moving element being in a housing which opens through a first orifice formed through a first principal face of a shank of the key near a lateral extremity of the shank;

the housing having an inclination substantially equal to 45 degrees relative to a plane perpendicular to a longitudinal median plane of the shank parallel to the first principal face, so that a tapered head of each moving element engages with a tapered head of the first moving rotor pin aligned with the first moving stator pin such that a common centerline of the first moving rotor pin and the first moving stator pin passes through a center of rotation of the rotor;

the housing also opening from the shank through a second orifice in a tapered bore formed in a second principal face of the shank of the key so that a rear part of the cylindrical body of the moving element engages with a tapered head of a second moving rotor pin aligned with a second spring-loaded moving stator pin; and a common centerline of the tapered bore and the second moving rotor pin is perpendicular to the longitudinal median plane of the shank and passes through the center of rotation of the rotor.

2. A lock in accordance with claim 1, wherein a centerline of the housing is slightly offset from the common centerline of the first moving rotor pin and the first moving stator pin.

3. A lock in accordance with claim 1, wherein the tapered bore and the tapered head of the second moving rotor pin (7) are angled substantially equal to 45 degrees from the longitudinal median plane of the shank.

4. A lock in accordance with claim 1, wherein an angle formed by the tapered head of each moving element is substantially equal to 45 degrees from the longitudinal median plane of the shank.

5. A lock in accordance with claim 1, wherein:

each of the first and second moving rotor pins include first and second cylindrical parts of different diameters;

first and second connecting parts connecting the first and second cylindrical parts of each of the first and second moving rotor pins; and the first and second connecting parts each abut against first and second shoulders formed by first and second bores in the rotor in which are accommodated the first and second cylindrical parts.

6. A lock in accordance with claim 1, wherein the first and second orifices of the housing each have a retention zone which prevents the moving element from escaping completely from these first and second orifices.

7. A lock in accordance with claim 1, further comprising:

several moving elements arranged in various planes perpendicular to the longitudinal median plane of the shank of the key;

one moving element in each of the various planes engaging with a first moving rotor pin and a second moving rotor pin arranged in a same plane as the associated moving element, perpendicularly to the center of rotation of the rotor.

8. A lock in accordance with claim 1, wherein a centerline of the housing is collinear with the common centerline of the first moving rotor pin and the first moving stator pin.

9. A flat key for a safety lock, comprising:

a shank with first and second principal faces and two narrow lateral faces therebetween;

a plurality of active bores being on at least one of the principal faces;

at least one moving element comprising a cylindrical body and an essentially tapered head;

the at least one moving element being held in a housing within the key;

the housing emerging through a first orifice formed through the first principal face of the shank of the key near one lateral extremity of the shank;

the housing having an inclination substantially equal to 45 degrees relative to a plane perpendicular to a longitudinal median plane of the shank parallel to the principal faces; and the housing also emerging through a second orifice in a tapered bore formed in the second principal face of the shank of the key.

10. A flat key in accordance with claim 9, wherein the first and second orifices of the housing each have a retention zone which prevents the moving element from escaping completely through these first and second orifices.

11. A flat key in accordance with claim 9, wherein the key is reversible and has a symmetrical configuration in relation to a longitudinal median plane perpendicular to the principal faces.

* * * * *